US006698910B2

(12) United States Patent
Wu

(10) Patent No.: US 6,698,910 B2
(45) **Date of Patent: *Mar. 2, 2004**

(54) FOLDING STRUCTURE OF A TWO LAYER LAMPSHADE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/059,386

(22) Filed: Jan. 31, 2002

(65) Prior Publication Data

US 2003/0142497 A1 Jul. 31, 2003

(51) Int. Cl.[7] ..... F21V 1/06

(52) U.S. Cl. ..... 362/352; 362/351; 362/355; 362/356; 362/357; 362/358; 362/433; 362/434

(58) Field of Search ..... 362/352, 351, 362/355–358, 434, 433, 435, 450; 24/573.1; 248/230.7, 230.8, 316.1, 316.7

(56) References Cited

U.S. PATENT DOCUMENTS 6,402,110 B1 * 6/2002 Berman et al. ..... 248/316.2

2002/0196631 A1 * 12/2002 Wu ..... 362/351

* cited by examiner

*Primary Examiner*—Stephen Husar
*Assistant Examiner*—Mark Tsidulko

(57) ABSTRACT

A folding structure of a two-layer lampshade is disclosed. The folding structure has a top ring at a topmost of the lampshade, a bottom ring having a diameter larger than that of the top ring, and a supporting frame between the top ring and the bottom ring. A plurality of supporting rods extend from a ring edge of the top ring toward a center of the top ring. The supporting frame is formed by a plurality of longitudinal rods and a plurality of transversal rods. Since the supporting frame is engaged to the bottom ring by the buckle, it can rotate to be positioned horizontally by using the buckles as fulcrums and the inner cloth and outer cloth of the lampshade encloses the folding structure. Thereby, the lampshade is assembled to have a smaller volume, As a consequence, the transfer cost is reduced.

2 Claims, 6 Drawing Sheets

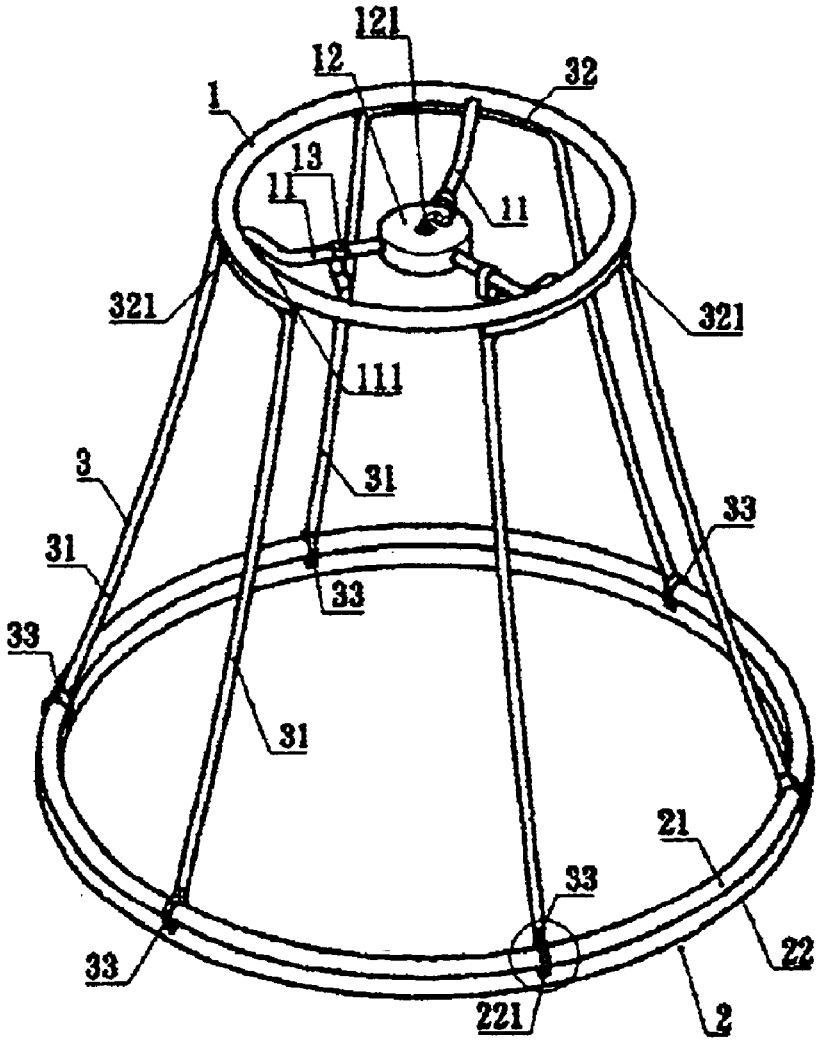
FIG2
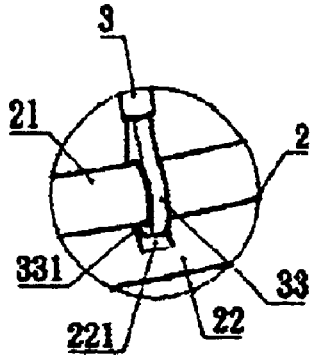
FIG2-A

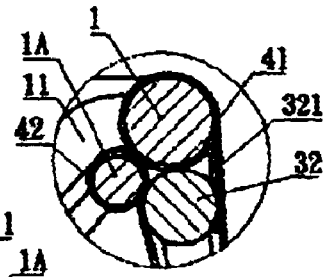
FIG5-A
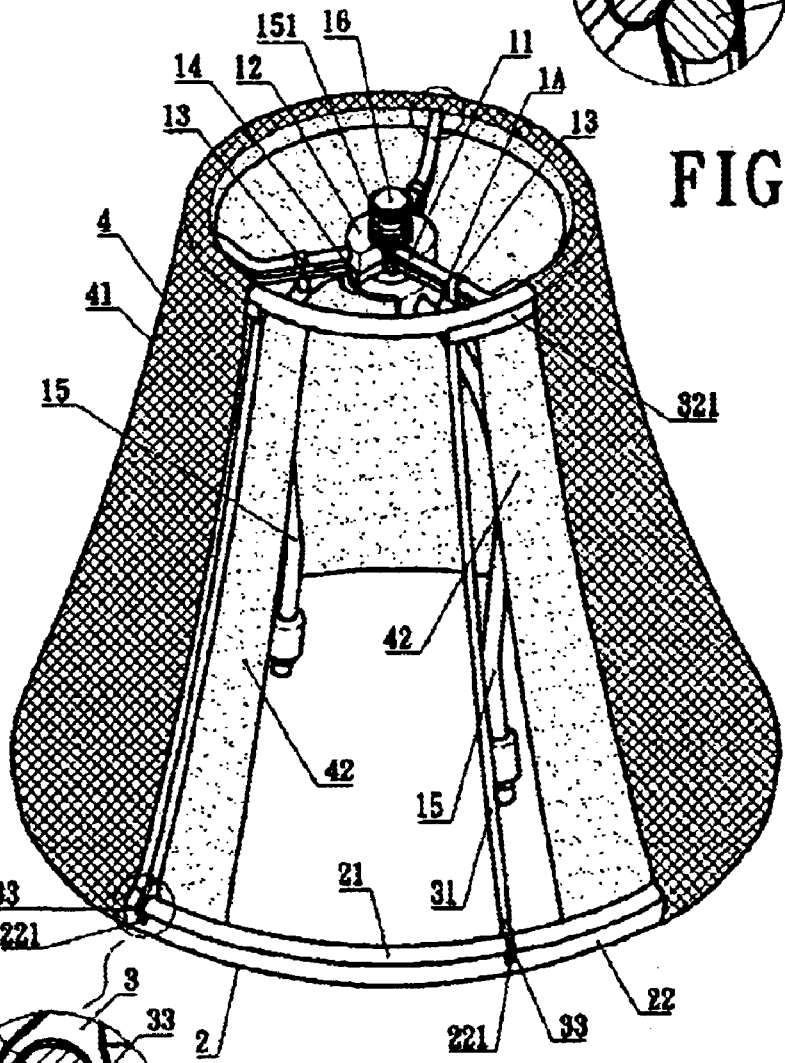
FIG5
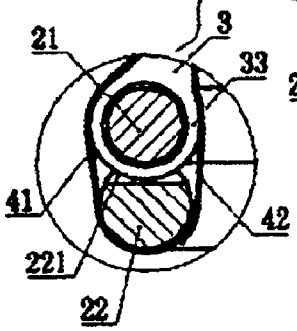
FIG5-B

FOLDING STRUCTURE OF A TWO LAYER LAMPSHADE

BACKGROUND OF THE INVENTION

The present invention relates to a lamp structure, and particularly to a folding structure of a two layer lampshade, wherein the lampshade can be assembled so as to have a smaller volume and thus the transfer cost is reduced.

Referring to FIG. 6, a conventional lampshade is illustrated. The supporting frame of the conventional lampshade is directly connected to a top ring and a bottom ring so as to form a lampshade. However, the prior art structure has many defects which are necessary to be improved. For example, the prior art lampshade is a rigid structure so that it is inconvenient to be assembled for transferring since the lampshade occupies a larger space. As a result, the cost for transferring is high.

SUMMARY OF THE INVENTION

Accordingly, the primary object of the present invention is to provide a folding structure of a two layer lampshade having a top ring at a topmost of the lampshade, a bottom ring having a diameter larger than that of the top ring, and a supporting frame between the top ring and the bottom ring. A plurality of supporting rods extend from an edge of the top ring toward a center of the top ring. A middle section of each supporting rod is firmly secured with a confining hook. An inner top ring is connected to the top ring through the confining hooks of the supporting rods. An opening of the upper ring is exactly clamped by the clamping portions of the supporting frame. The supporting frame is formed by a plurality of longitudinal rods and a plurality of transversal rods. A cloth lampshade covers a periphery of the top ring and the bottom ring; the lampshade is formed by a layer of outer cloth which is tightly stuck to a periphery of the top ring and bottom ring. A layer of inner cloth is stuck to the bottom ring. When the lampshade is packaged, the inner top ring can be taken down from the confining hook. Since the supporting frame is engaged to the bottom ring by the buckle, it can rotate to a horizontal position by using the buckles as fulcrums. Thereby, the lampshade can be assembled to have a smaller volume and further the transfer cost is reduced.

The various objects and advantages of the present invention will be more readily understood from the following detailed description when read in conjunction with the appended drawing.

BRIEF DESCRIPTION OF THE DRAWINGS

FIG. 2 is an assembled perspective view of the present invention.

FIG. 2-A is an enlarged view showing a bottom ring and a supporting frame of the present invention.

FIG. 5 is a cross sectional view of the lampshade of the present invention.

FIG. 5-A shows a partial plane cross sectional view illustrating the connection of the top of the lampshade.

FIG. 5-B shows a partial plane cross sectional view illustrating the connection of the bottom of the lampshade.

DETAIL DESCRIPTION OF THE PREFERRED EMBODIMENT

Figure 4:
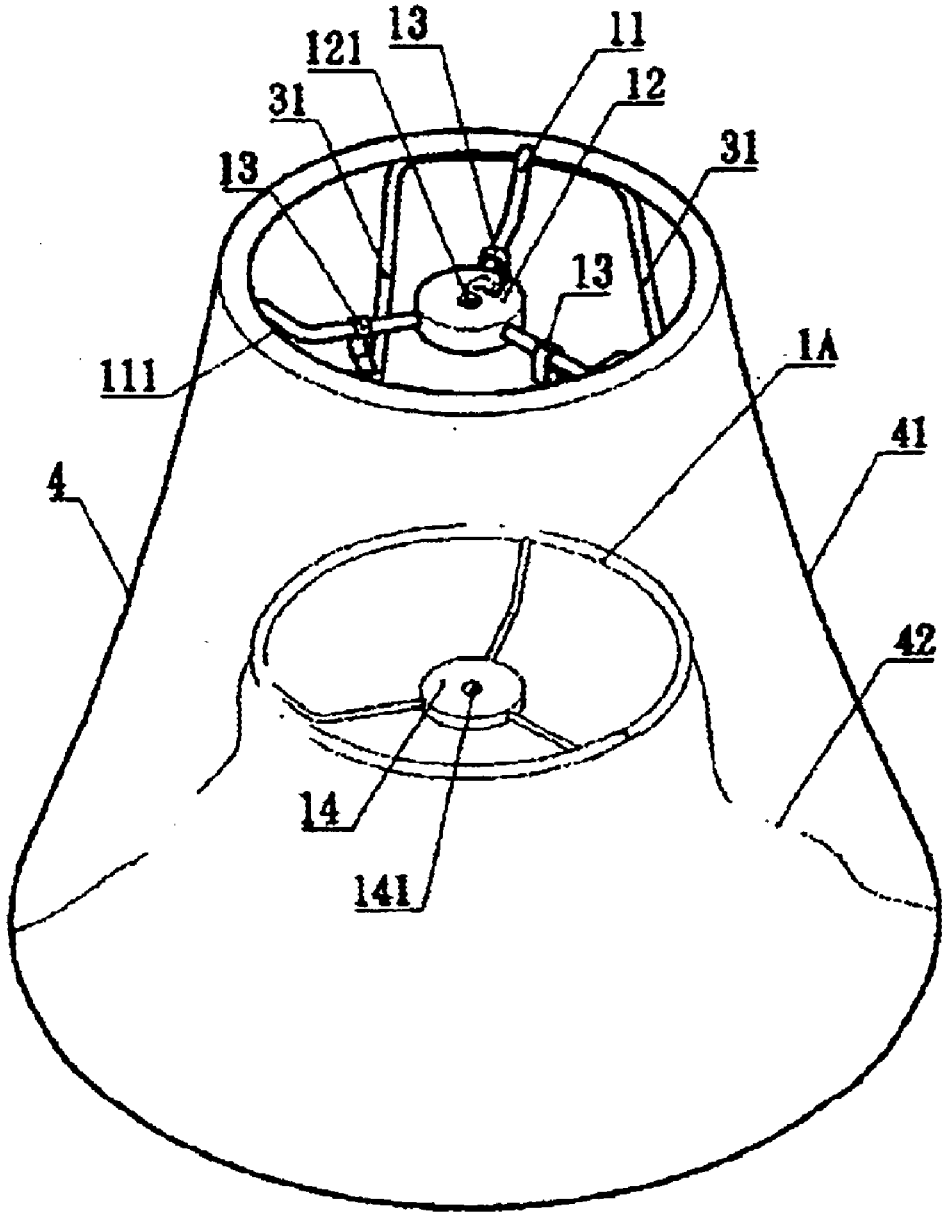
FIG. 4 is a schematic perspective view of the lampshade of the present invention.
Figure 6:
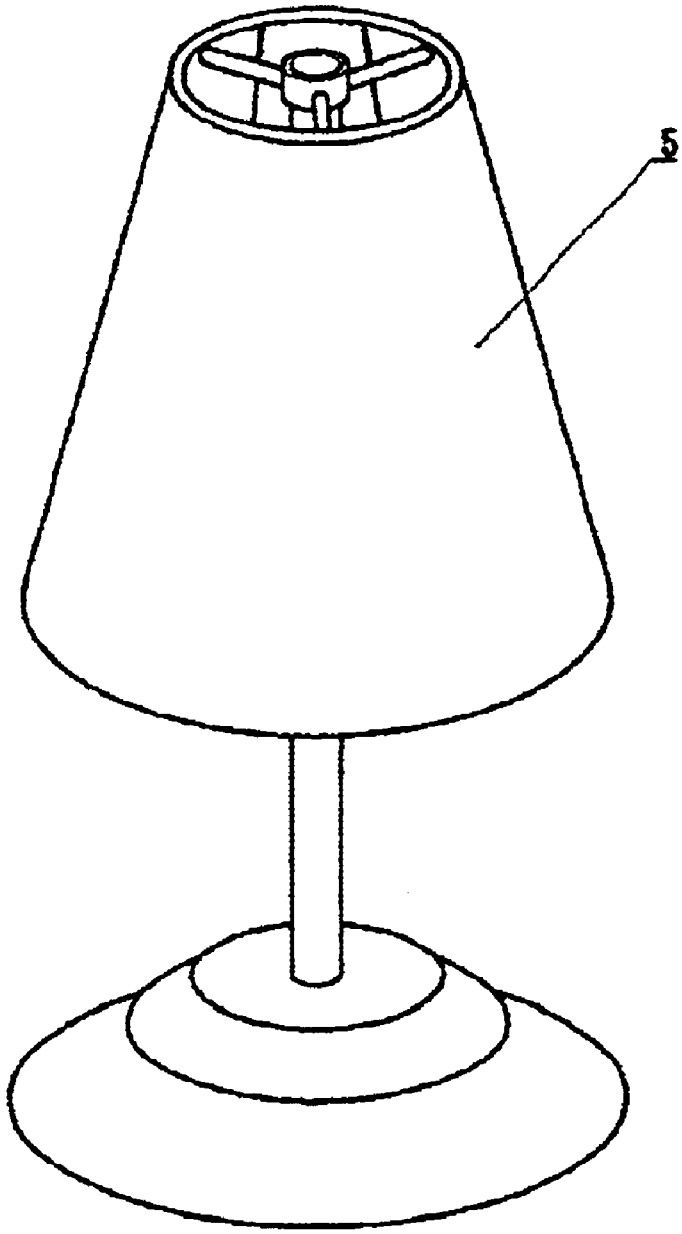
FIG6 PRIOR ART
FIG. 6 is a perspective view showing a prior art lampshade.

Referring to FIG. 4, the structure of the present invention is illustrated. The folding structure of a two-layer lampshade of the present invention is illustrated. The folding structure of a two-layer lampshade has a top ring 1 at a topmost of the lampshade, a bottom ring 2 having a diameter larger than that of the top ring 1, and a supporting frame 3 between the top ring 1 and the bottom ring 2.

The top ring 1 exactly resists against a stand rod of a table lamp. A plurality of supporting rods 11 extends from the ring edge of the top ring 1 toward a center of the top ring 1. A ring edge of each supporting rod 11 is bent upwards to form as a receiving space 111. A central ring 12 having a through hole 121 is installed at the connection of the supporting rods 11. The center of each supporting frame 3 has a limiting hook 13 for installing an inner top ring 1A.

The bottom ring includes an upper ring 21 with an opening S at a predetermined portion thereof, and a lower ring 22 sticky to a lower end of the upper ring 21. The opening S of the upper ring 21 is exactly clamped by the clamping portions 33 of the supporting frame 3. At the portions of the lower ring 22 clamped by the supporting frame 3 have stopping grooves 221 for confining the movement of the supporting frame 3.

The supporting frame 3 is formed by a plurality of longitudinal rods 31 and a plurality of transversal rods 32. Each transversal rod 32 of the supporting frame 3 has a stopping sheet 321 protruded from a lateral side thereof. The stopping sheet 321 is exactly confined to the bottom of the top ring 1 so as to prevent the supporting frame 3 from releasing due to collision. A lower end of each longitudinal rod 31 of the supporting frame 3 is punched to form a flat buckle 33 with a through hole 331 at a center thereof. The supporting frame 3 can be coupled with the bottom ring 2 by the buckles 33.

A cloth lampshade 4 covers the periphery of the top ring 1 and the bottom ring 2. The lampshade is formed by a layer of outer cloth 41 which is tightly stuck to the periphery of the top ring 1 and bottom ring 2. A layer of inner cloth 42 is stuck to the bottom ring 2. One end of the inner cloth is stuck to the inner top ring 1A which may resist against the lower side of the top ring 1. The inner top ring 1 and the inner cloth 42 can be hooked to the confining hooks of the top ring 1 so that the inner cloth 42 is fixed to the inner edge of the supporting frame 3. Thereby, the inner and outer cloths are installed at the outer and inner sides of the supporting frame 3.

Figure 1:
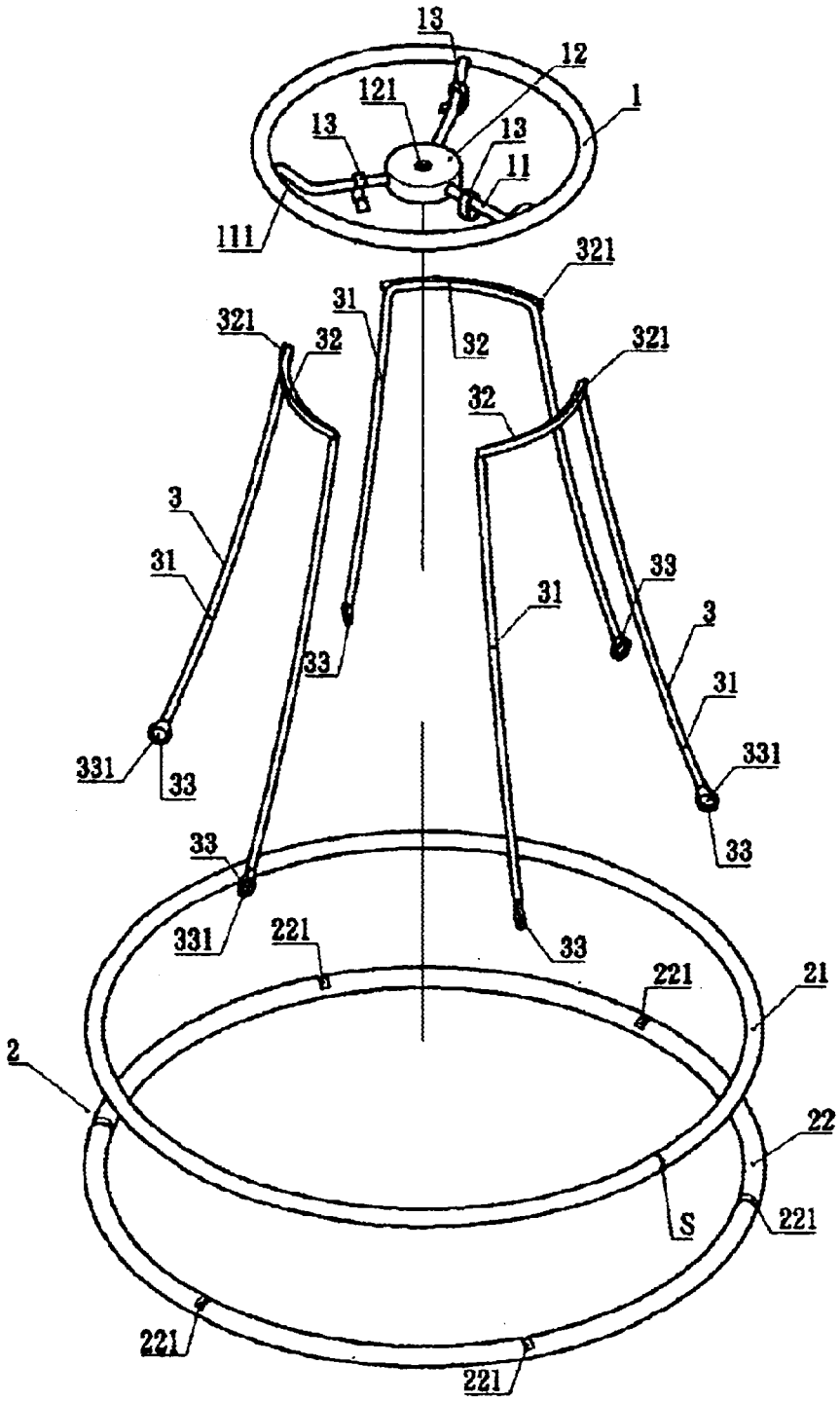
FIG. 1 is an exploded perspective view of the present invention.
Figure 3:
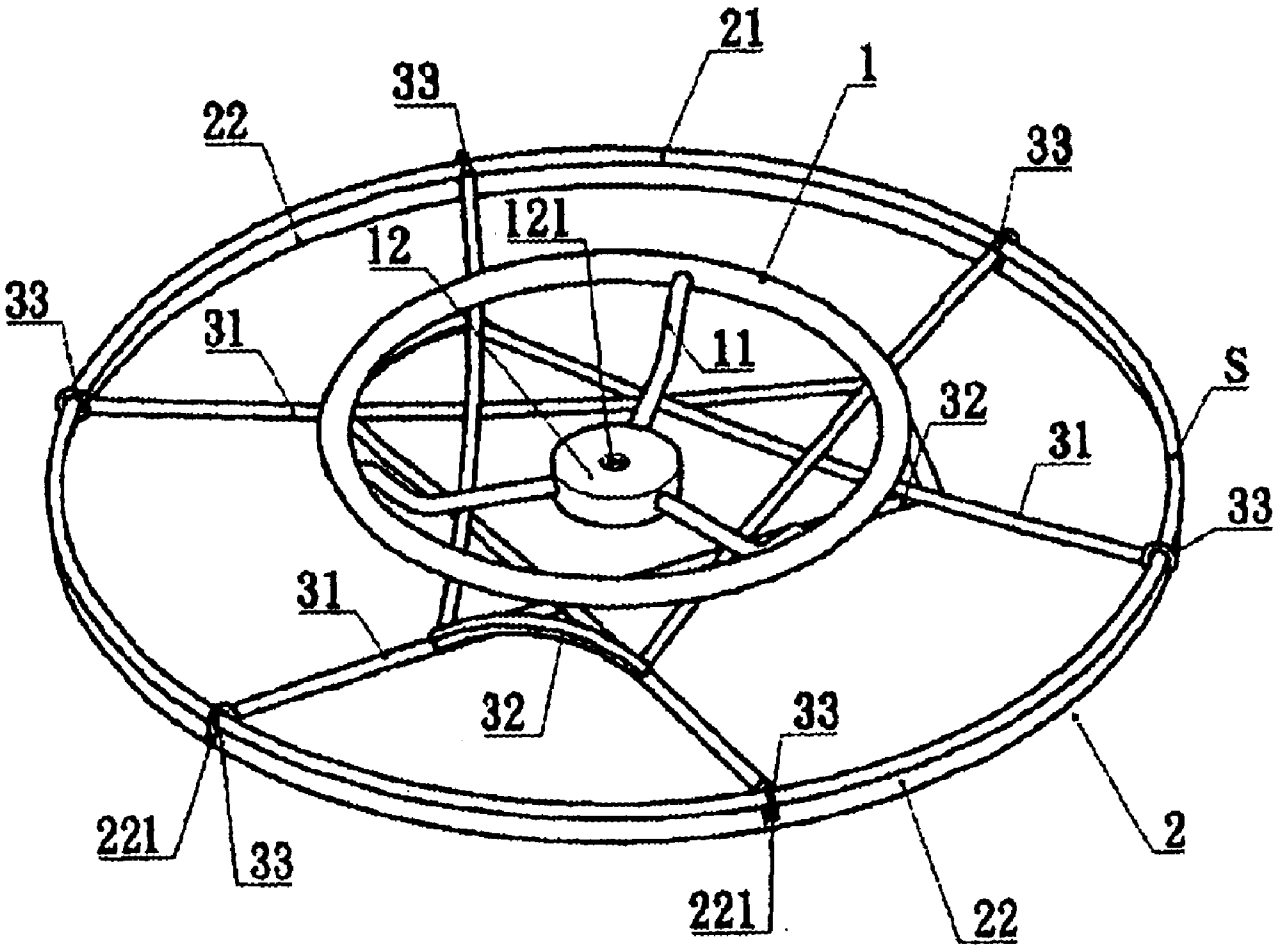
FIG. 3 shows one embodiment of the present invention.

Thereby, when the lampshade is packaged, the inner top ring 1A can be taken down from the confining hook 13. Since the supporting frame 3 is engaged to the bottom ring 2 by the buckle 33, it can rotate to a horizontal position by using the buckles 33 as fulcrums, as illustrated in FIG. 3. Thereby, the lampshade 4 is assembled to have a smaller volume. As a consequence, the transfer cost is reduced.

Further, referring to FIG. 5, a central ring 14 having a through hole 141 extends from an edge of the inner top ring 1A to the center thereof and the central ring 14 is exactly aligned to the central ring 12 of top ring 1. Thereby, a bubble frame 15 with a threaded rod 151 at a top end thereof may pass through the through holes 141, 121 of the inner top ring 1A and a top ring 1. A nut 16 is used to lock the structure so as to fix the bubble frame to the supporting frame 3.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A folding structure of a two-layer lampshade having a top ring at a topmost of the lampshade, a bottom ring having a diameter larger than that of the top ring, and a supporting frame between the top ring and the bottom ring; wherein a plurality of supporting rods extends from an edge of the top ring toward a center of the top ring; a middle section of each supporting rod is firmly secured with a confining hook; an inner top ring is connected to the top ring through the confining hooks of the supporting rods;

the bottom ring includes an upper ring with an opening at a predetermined portion thereof, and a lower ring sticky to a lower end of the upper ring; the opening of the upper ring is exactly clamped by the clamping portions of the supporting frame; at the portions of the lower ring clamped by the supporting frame have stopping grooves for confining the movement of the supporting frame;

the supporting frame is formed by a plurality of longitudinal rods and a plurality of transversal rods; each transversal rod of the supporting frame has a stopping sheet protruded from a lateral side thereof; the stopping sheet is exactly confined to a bottom of the top ring; a lower end of each longitudinal rod of the supporting frame is punched to form a flat buckle with a through hole at a center thereof; the supporting frame is coupled with the bottom ring by the buckles;

a cloth lampshade covers a periphery of the top ring 1 and the bottom ring; the lampshade is formed by a layer of outer cloth which is tightly stuck to a periphery of the top ring and bottom ring; a layer of inner cloth is stuck to the bottom ring; one end of the inner cloth is stuck an inner top ring which resists against a lower side of the top ring; the inner top ring and the inner cloth are hooked to the confining hooks of the top ring so that the inner cloth is fixed to an inner edge of the supporting frame; thereby, the inner and outer cloths are installed at the outer and inner sides of the supporting frame;

thereby, when the lampshade is packaged, the lampshade is assembled by a smallest volume and further the transfer cost is reduced.

2. The folding structure of a two-layer lampshade as claimed in claim 1, wherein the top ring and the inner top ring have respective central rings; each central ring has a through hole; the central ring of the top ring is exactly aligned to the central ring of the inner top ring; thereby, a bubble frame with a threaded rod at a top end thereof passes through the through holes of the inner top ring and a top ring; a nut is used to lock the threaded rod so as to fix the bubble frame to the supporting frame.

* * * * *